United States Patent [19]

Vago et al.

[11] Patent Number: 4,889,105

[45] Date of Patent: Dec. 26, 1989

[54] WATER HEATER CONSTRUCTION AND METHOD OF MANUFACTURE

[75] Inventors: Otto Z. Vago, Burns; Ernest Wenczl, Nashville, both of Tenn.

[73] Assignee: State Industries, Inc., Ashland City, Tenn.

[21] Appl. No.: 877,701

[22] Filed: Jun. 20, 1986

Related U.S. Application Data

[63] Continuation of Ser. No. 595,388, Mar. 30, 1984, abandoned.

[51] Int. Cl.[4] ..... F24H 1/00

[52] U.S. Cl. ..... 126/361; 29/458; 29/157.4; 165/133

[58] Field of Search ..... 126/344, 361; 29/460, 29/458, 157.4; 228/183, 184; 165/133, 172, 173, 175, 178; 122/155 R, 114; 220/459

[56] References Cited

U.S. PATENT DOCUMENTS

| | | | |
|---|---|---|---|
| 1,387,901 | 8/1921 | Payne | 165/175 X |
| 2,229,526 | 1/1941 | Schabacker | 126/36 X |
| 2,281,407 | 4/1942 | Bohnsack | 220/459 X |
| 2,322,488 | 6/1943 | Uecker | 126/361 X |
| 2,384,324 | 9/1945 | Martin | 29/458 |
| 2,398,788 | 4/1946 | Hedrick | 29/458 |
| 2,540,052 | 11/1951 | Martin | 29/458 |
| 2,625,138 | 1/1953 | Jacoby | 122/17 |
| 2,656,949 | 10/1953 | Leupold | 29/460 X |
| 2,764,427 | 9/1956 | Andrus | 126/361 X R |
| 2,777,194 | 1/1957 | Ashley | 29/458 |
| 2,959,850 | 11/1960 | Deringer | 29/458 |
| 3,268,489 | 8/1966 | Erwin et al. | 165/133 X |
| 3,628,923 | 12/1971 | White | 228/183 X |
| 3,945,431 | 3/1976 | Straub | 29/157.4 X |
| 4,415,020 | 11/1983 | Daugirda | 165/133 X |

*Primary Examiner*—Randall L. Green
*Attorney, Agent, or Firm*—Paul R. Puerner

[57] ABSTRACT

A water heater tank assembly having a shell with top and bottom heads welded in opposite ends thereof. The heads have aligned flue tube mounting openings therein in which metal collar members are welded. Flue tubes are mounted in and welded to the collar members. The collar members serve as a heat sink to prevent damage to the glass lining on the shell, head members and flue tubes during the various welding operations.

9 Claims, 1 Drawing Sheet

WATER HEATER CONSTRUCTION AND METHOD OF MANUFACTURE

This is a continuation of Ser. No. 595,388, filed 3/30/84, now abandoned.

BACKGROUND OF THE INVENTION

1. Field of the Invention

This invention relates to the construction of a gas fired water heater having a plurality of flue tubes extending between the opposite heads of the tank and to the method of manufacturing the tank.

2. Description of the Prior Art

In a conventional gas water heater, the flue tubes are welded directly to the bottom and top heads of the tank. The high temperatures produced when the glass lined flue tubes, tank heads and bottoms and tank shells are welded together can cause the corrosion-protective glass-lining surfaces to chip and crack, exposing the bare steel underneath. Such flaws in the glass-lining surface often lead to premature tank failure.

The object of the present invention is to provide a water heater construction and method of manufacture wherein the problem of cracking of the glass lining due to weld heat and accompanying stresses in the various joint, radius and adjoining areas is substantially eliminated.

SUMMARY OF THE INVENTION

A water heater tank assembly including a shell having top and bottom head members welded in the ends thereof. The top and bottom head members have aligned flue tube mounting openings therein in which metal collar members are welded prior to glass lining of the head members. Top and bottom head members are press-fitted into the shell and welded thereto after flue tubes are mounted in and welded to the collar members. The collar members serve as a heat sink to prevent damage to the glass lining by the heat generated when welding the flue tubes to the collar members. The top and bottom head members have elongated flanges so that when the flanges are welded to the shell, the heat produced will not damage the glass lining.

DESCRIPTION OF THE PREFERRED EMBODIMENT

The water heater tank construction of the present invention relates to gas or oil fired water heaters and more particularly to commercial gas or oil fired water heaters.

Figure 1:
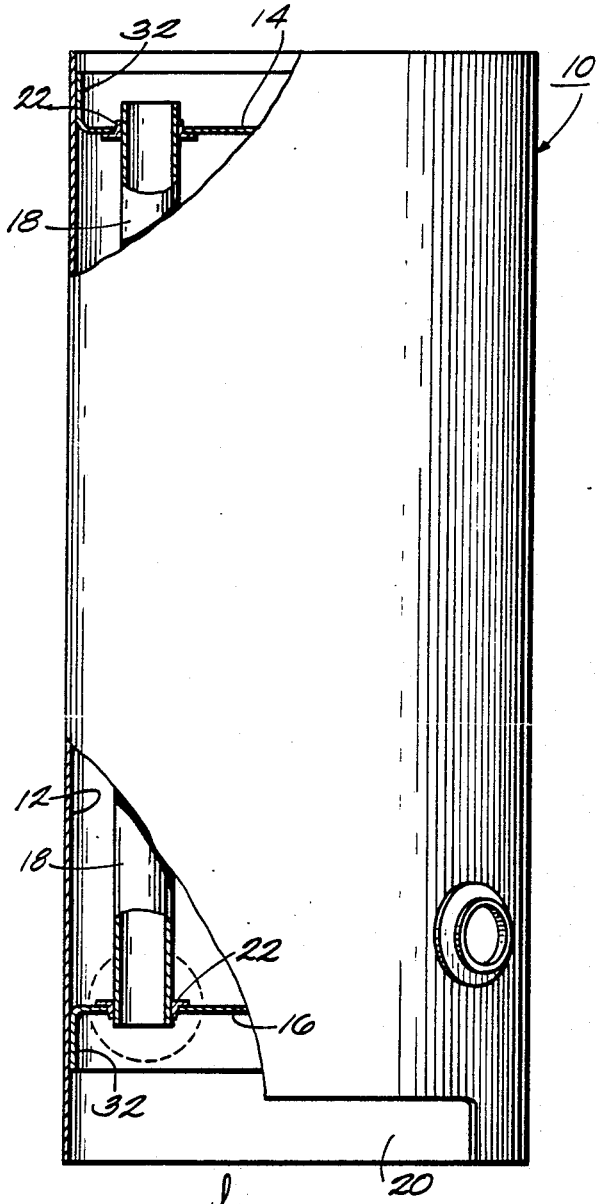
FIG. 1 is a side elevation view (with parts broken away) of a water heater tank assembly constructed in accordance with the present invention.
Figure 2:
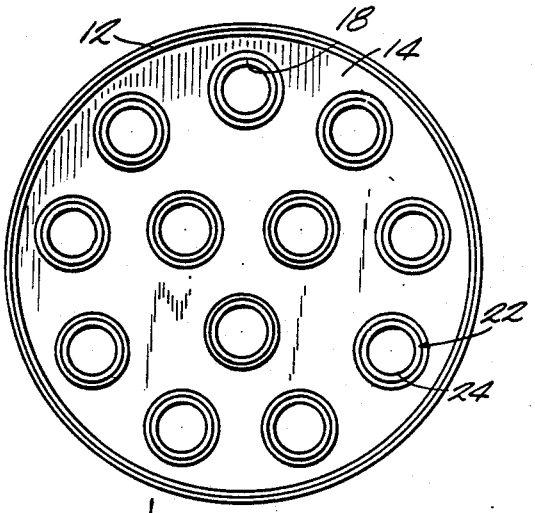
FIG. 2 is a top plan view of the water heater tank shown in FIG. 1.

Referring to FIG. 1, the water heater tank assembly 10 is constructed of the following basic parts, namely, a shell 12, a top head member 14, a bottom head member 16 and a plurality of flue tubes 18. Top and bottom head members 14 and 16 are provided with flanges 32. A gas or oil burner assembly (not shown) of any suitable design is mounted in the combustion chamber 20 beneath the bottom head member 16. The products of combustion which pass upwardly through flue tubes 18 are carried from the heater by an appropriate venting means of any suitable design mounted on the top of the heater.

Figure 4:
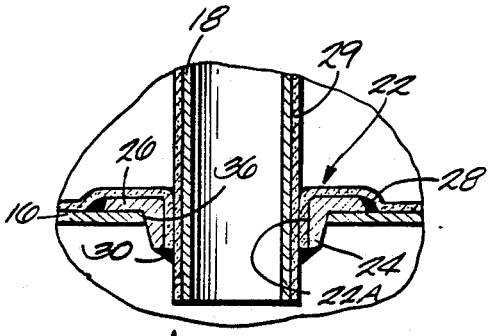
FIG. 4 is an enlarged fragmentary sectional view of the circled portion of the water tank shown in FIG. 1.

As best shown in FIG. 4, an important feature of the present invention is the use of collar members 22 for mounting flue tubes 18 in top and bottom head members 14 and 16. Each collar member 22 is comprised of a circular flange portion 26 having a cylindrical body portion 24 extending therefrom and formed integrally therewith. Collar members 22 are mounted in flue tube mounting openings 36 in the top and bottom head members 14 and 16. Details of the construction and advantages attained by collar members 22 will be set forth in detail hereinafter.

In the preferred embodiment, the water heater of the present invention is constructed as follows.

The first step is to mount collar members 22 in openings 36 in top and bottom head members 14 and 16 with the flange portions 26 positioned against the inside surface of the head members. The next step is to weld the flange 26 of each collar 22 to the inside surface of the top and bottom head members 14 and 16 by a weld designated by reference numeral 28. It should be noted at this point that the final assembly arrangement of collar members 22 and flue tubes 18 in top head 14 and bottom head 16 is identical, so identical reference numerals are used.

The next step is to apply a glass lining to what will become the inside (water side) of top and bottom head members 14 and 16 with collar members 22 welded thereto. The glass lining will thus cover the inner surface of the head members and the surfaces of the collar flanges 26 and the weld 28 between the flanges and the inner surfaces 22A of the cylindrical body portions of the collars 22. The reference numeral 29 designates the glass lining on the interior surfaces of the water heater. It will be appreciated that the glass lining is not drawn to scale.

The next step is to press fit the top member 14 and the bottom member 16 into the ends of shell member 12 with flanges 32 thereon extending upwardly and downwardly away from the interior of the shell. The shell member will have had a glass lining applied to its internal surface prior to this step.

Either the flange 32 of the top head member 14 or the bottom head member 16 is then welded to the shell by a weld 34. For purposes of explanation, the bottom head 16 will be welded to shell 12 first. Flange 32 is made sufficiently long so that the glass lining on the head will not be damaged when weld 34 is made. In the preferred embodiment, the minimum length of flange 32 on top and bottom head members 14 and 16 is approximately $2\frac{7}{8}$ inches.

Next, flue tubes 18 are inserted into collars 22 with the opposite ends of the flue tubes 18 extending past the ends of the cylindrical body portions 24 of collar members 22. The flue tubes 18 will have been glass-lined on their external surface prior to such assembly.

Next, the lower ends of flue tubes 18 are welded to the ends of cylindrical body portions 24 of collars 22 by welds 30. Here again, by the use of collars 22 having a configuration as described above, weld 30 will be made at a location remote from the glass lining on the head 16 and collar flanges 26. The metal of the collar body 24 and flange 26 act as a heat sink during welding to thus prevent damage to the glass lining. In the preferred embodiment, the minimum length of cylindrical body portions 24 (from the top surface of flanges 26) is approximately 13/16 inches.

Figure 3:
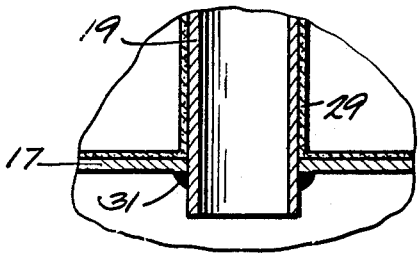
Fig. 3 PRIOR ART
FIG. 3 is a fragmentary sectional view showing a typical prior art water heater tank construction.
Figure 5:
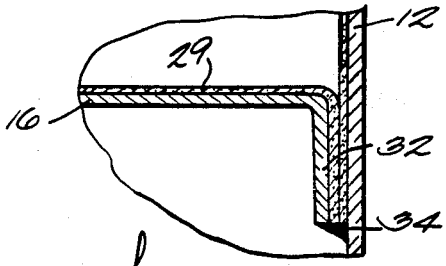
FIG. 5 is an enlarged fragmentary sectional view of the joint between the bottom head member and the shell.

At this point, reference is made to FIG. 3, which shows a typical prior art water heater tank construction. As shown, the flue tubes 19 are welded directly to the head 17. Because of the close proximity of the weld 31 to the bottom head glass lining 29, the heat produced, when making the weld, could, in some instances, cause the glass lining to crack, ultimately leading to premature tank failure.

Next, the upper ends of flue tubes 18 are welded to the ends of cylindrical body portions 24 of collars 22 by a weld 30. Here again, collars 22 serve as a heat sink during welding to prevent damage to the glass lining on top head 14.

The final step is to weld the flange 32 of top head 14 to the shell 12 by a weld 34.

It should be noted at this point that it is important to make welds 30 at both the top and bottom of flue tubes 18 before the final weld 34 is made between the top head 14 and the shell. By following this procedure, the top head can "float" with respect to the shell when welds 30 are made. It will be appreciated that when welds 30 are made, there will be some expansion and contraction of the parts, which movement will be accommodated by the "floating" relationship between the top head and the shell.

We claim:

1. A water heater tank assembly comprising:

a shell having a top head member and a bottom head member welded in the ends thereof, said top and bottom head members having a plurality of aligned flue tube mounting openings therein;

a plurality of metal collar members mounted in said flue tube mounting openings, each of said collar members having a cylinder flange portion and a cylindrical body portion extending therefrom, said collar members mounted in said flue tube mounting openings with said flange portions positioned against the inside surface of said top and bottom head members and with said cylindrical body portions extending through said flue tube mounting openings to a point above and below the external surface of said top and bottom head members, said collar members being welded to said top and bottom head members by a weld extending around the periphery of said flange portions on said collar members; and a plurality of flue tubes mounted in the cylindrical body portions of said collar members with the ends of said flue tubes extending past the ends of said cylindrical body portions of said collar members, said flue tubes welded to said collar members by a weld extending around the ends of said cylindrical body portions of said collar members;

said water heater tank assembly further characterized by a glass lining fused to the interior surfaces of said tank assembly including the external surfaces of said flue tubes; and said tank assembly further characterized wherein the longitudinal length of said cylindrical body portions of said collar members is of sufficient length so that said welds made at the ends of said cylindrical body portions will be sufficiently remote from the glass lining on the interior of said top and bottom head members so that the heat generated by said welds will not damage said glass lining.

2. A water heater tank assembly according to claim 1 in which the minimum length of the cylindrical body portions of said collar members is approximately 13/16 inches.

3. A water heater tank assembly according to claim 1 in which said top and bottom head members have flanges thereon which fit snugly inside said shell and which extend downwardly and upwardly away from the interior of said shell, said top and bottom head members welded to said shell by welds extending around the ends of said flanges on said top and bottom head members.

4. A water heater tank assembly according to claim 3 in which said flanges on said top and bottom head members are sufficiently long so that the heat generated by the welds around the ends of said flanges will not damage the glass lining on the interior of said shell and top and bottom head members.

5. A water heater tank assembly according to claim 4 in which the minimum length of said flanges on said top and bottom head members is approximately $2\frac{7}{8}$ inches.

6. A method of manufacturing a water heater tank assembly comprising the steps of:

(a) mounting a plurality of collar members in the flue tube mounting openings in a top head member and a bottom head member, said collar members having a circular flange portion and a cylindrical body portion extending therefrom, said collar members mounted in said flue tube mounting openings with said flange portions positioned against the water side surface of said top and bottom head members and with said cylindrical body portions extending through said flue tube mounting openings to points above and below the external surface of said top and bottom head members;

(b) next, welding the flange portion of each collar member to the inside surface of the top and bottom head members;

(c) next, applying a glass lining to the water side surface of top and bottom head members with the collar members welded thereto;

(d) next, friction fitting said top and bottom head members into the opposite ends of a shell member having an internal and an external surface, said shell member having had a glass lining applied to its internal surface prior to this step;

(e) next, welding either the top or bottom member to the shell;

(f) next, inserting flue tube members into the collar members with the ends of the flue tube members extending past the ends of the cylindrical body portions of the collar members, the flue tubes having been glass lined on their external surface prior to this step;

(g) next, welding the flue tubes members to the cylindrical body portions of the collar members; and (h) next, welding either the top or bottom head member to the shell depending upon whether the top or bottom member was welded to the shell in step (e).

7. A method of manufacturing a water heater tank assembly according to claim 6 in which the welds between said flange portion of the collar members and the top and bottom heads (step b) extend around the periphery of said flange portions.

8. A method of manufacturing a water heater tank assembly according to claim 6 in which the welds between the cylindrical body portions of the collar members and the flue tube members (step g) extend around the ends of said cylindrical body portions.

9. The method of manufacturing a water heater tank assembly according to claim 6 in which said top and bottom head members have flanges thereon which fit snugly inside the shell and which extend downwardly and upwardly from the interior of the shell, said welds between the top and bottom head members and the shell (steps e and h) extending around the ends of the flanges on the top and bottom head members.

* * * * *